US007114926B2

(12) United States Patent
Oshita et al.

(10) Patent No.: US 7,114,926 B2
(45) Date of Patent: Oct. 3, 2006

(54) WATER PUMP FOR COOLING ENGINE

(75) Inventors: Tohru Oshita, Saitama (JP); Toshimitsu Suzuki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 84 days.

(21) Appl. No.: 10/806,219

(22) Filed: Mar. 23, 2004

(65) Prior Publication Data

US 2004/0247444 A1 Dec. 9, 2004

(30) Foreign Application Priority Data

Mar. 25, 2003 (JP) ..... 2003-081930

(51) Int. Cl.
*F04D 29/36* (2006.01)

(52) U.S. Cl. ..... 416/207; 416/245 A; 123/41.47

(58) Field of Classification Search ..... 416/207, 416/245 A, 246, 244 R, 204 R; 415/206; 123/41.44, 41.46, 41.47
See application file for complete search history.

(56) References Cited

U.S. PATENT DOCUMENTS 4,257,744 A * 3/1981 Watson ..... 416/244 R
4,530,313 A * 7/1985 Zaremba ..... 123/41.47
6,523,627 B1 * 2/2003 Fukuda ..... 180/68.4

FOREIGN PATENT DOCUMENTS

JP 2000-88056 A 3/2000

* cited by examiner

*Primary Examiner*—Edward K. Look
*Assistant Examiner*—Dwayne J White
(74) *Attorney, Agent, or Firm*—Birch, Stewart, Kolasch and Birch, LLP

(57) ABSTRACT

A water pump for cooling an engine in which an impeller accommodated in a pump housing provided on an engine body is mounted on an end of a rotational shaft rotatably supported on the pump housing for enhancing the reliability of the mounting strength of the impeller while avoiding an increase in cost. A fitting recess for fitting an end of the rotational shaft having an outer circumferential surface which is straight in an axial direction at least in a portion on the impeller side is provided in a central portion of the impeller. A bolt inserted into the central portion of the impeller is threaded in a coaxial direction with the end of the rotational shaft in a state that is fitted in the fitting recess.

16 Claims, 5 Drawing Sheets

WATER PUMP FOR COOLING ENGINE

CROSS-REFERENCE TO RELATED APPLICATIONS

The present application claims priority under 35 USC 119 to Japanese Patent Application No. 2003-081930 filed on Mar. 25, 2003 the entire contents thereof is hereby incorporated by reference.

BACKGROUND OF THE INVENTION

1. Field of the Invention

The present invention relates to an improvement in a water pump for cooling an engine in which an impeller accommodated in a pump housing provided on an engine body is mounted on an end of a rotational shaft supported rotatably on the pump housing.

2. Description of Background Art

A water pump for cooling an engine having a male thread threaded on the outer circumference of one end of a rotational shaft and mounted relative to a central portion of an impeller to thereby mount the impeller on the end of the rotational shaft has been known, for example, in Japanese Patent Laid-Open No. 2000-88056.

A reaction generated by receiving fluid resistance caused by the cooling liquid within the pump housing exerts a bending load on the rotational shaft through the rotating impeller. In the above-described prior art, a small diameter shaft having a male thread on the outer circumference thereof is provided coaxially with the end of the rotational shaft. The bending load is concentrically exerted on the base of the shaft. Therefore, when an attempt is made to increase the number of rotations of the engine and to make the impeller a larger size, there is possibly an affect on the reliance of strength of the base of the shaft. When an attempt is made to produce a shaft with a larger diameter, the rotational shaft itself becomes a larger diameter. Thus, changes or modifications are necessary for other parts constituting the water pump, resulting in an increase in costs.

SUMMARY AND OBJECTS OF THE INVENTION

The present invention has been accomplished in view of the foregoing. It is an object of the invention to provide a water pump for cooling an engine for enhancing the reliability of mounting strength of an impeller to a rotational shaft while avoiding an increase in costs.

For achieving the above-described object, the present invention provides a water pump for cooling an engine in which an impeller accommodated in a pump housing provided on an engine body is mounted on an end of a rotational shaft rotatably supported on the pump housing. A fitting recess is provided for fitting an end of the rotational shaft having an outer circumferential surface which is straight in an axial direction at least in a portion on the impeller side that is provided in a central portion of the impeller. A bolt inserted into the central portion of the impeller is threaded to be coaxial with the end of the rotational shaft in a state that is fitted in the fitting recess.

According to the structure of the present invention as described above, the end of the rotational shaft is fastened to the impeller in the state that is fitted in the fitting recess in the central portion of the impeller. Therefore, the bending load is exerted on the fitting portion of the rotational shaft and the impeller so as to prevent the bolt from being applied with the bending load. Further, since at least the outer circumferential surface on the impeller side of the rotational shaft is formed to be straight without a difference in level, the rotational shaft is relatively large in diameter at the fitting portion, and the reliance of the mounting strength of the impeller can be enhanced without making the rotational shaft itself larger in size. Thus, changes or modifications with respect to other parts constituting the water pump are unnecessary; and an increase in costs can be avoided. Moreover, the work necessary to provide a difference in the level on the outer circumferential surface of the portion on the impeller side of the rotational shaft is unnecessary. This also results in a reduction in the costs of production.

Further, in the present invention in the central portion of the impeller an engaging recess for fitting an enlarged diameter head portion of the bolt relatively unrotatably is provided and faces opposite to the fitting recess. The rotational direction of the rotational shaft and the impeller is set to the direction in which the bolt is further tightened by the resistance that the impeller receives from the cooling liquid within the pump housing. According to this construction as described above, even if the bolt should be loosened, the bolt is further tightened by the rotation of the impeller. Therefore, positive fastening of the bolt to the rotational shaft, that is, positive fastening of the impeller to the rotational shaft can be maintained.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The form of carrying out the invention will be described hereinafter on the basis of one embodiment of the present invention shown in the accompanying drawings.

Figure 1:
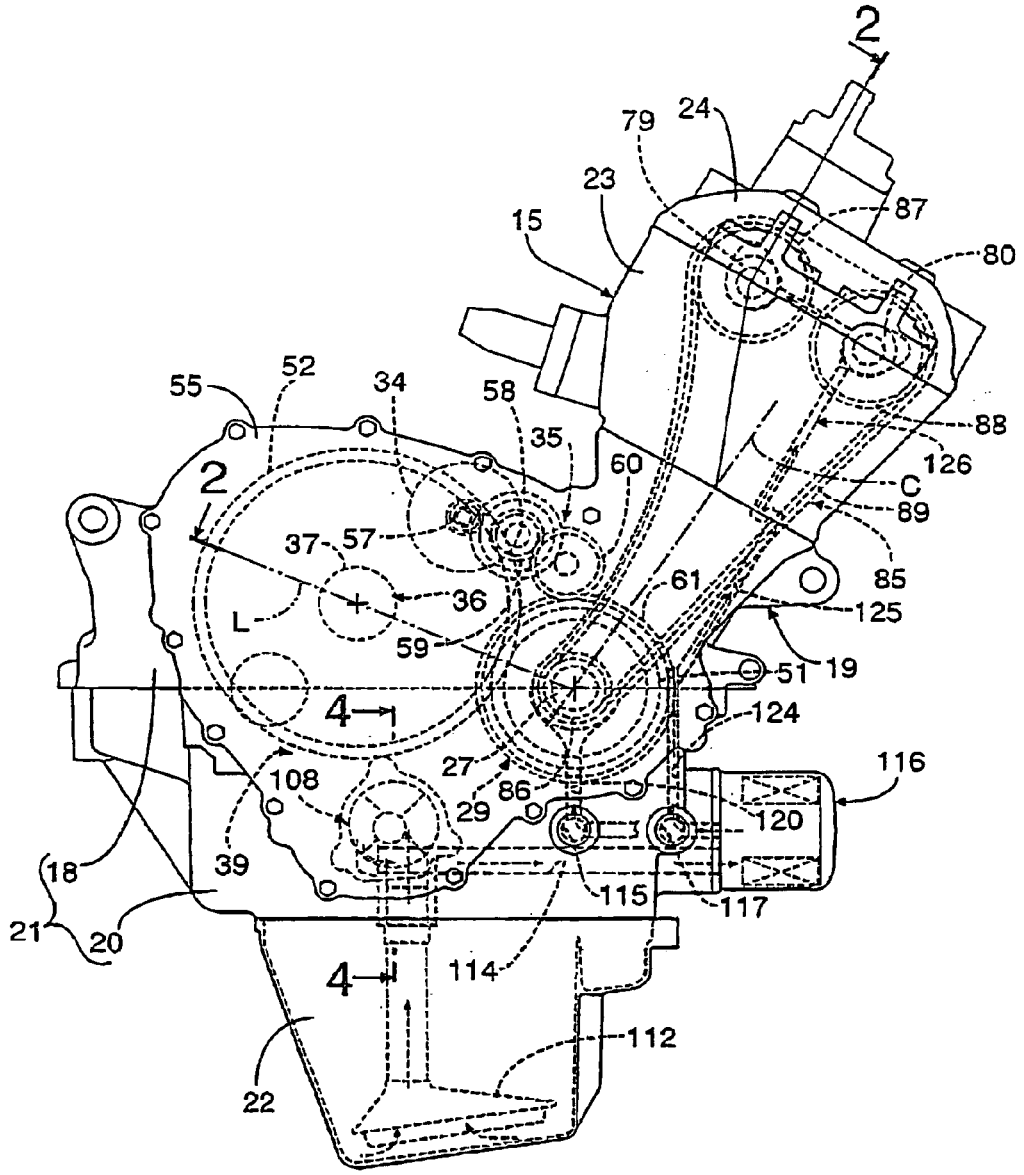
FIG. 1 is a side view of the engine.
Figure 2:
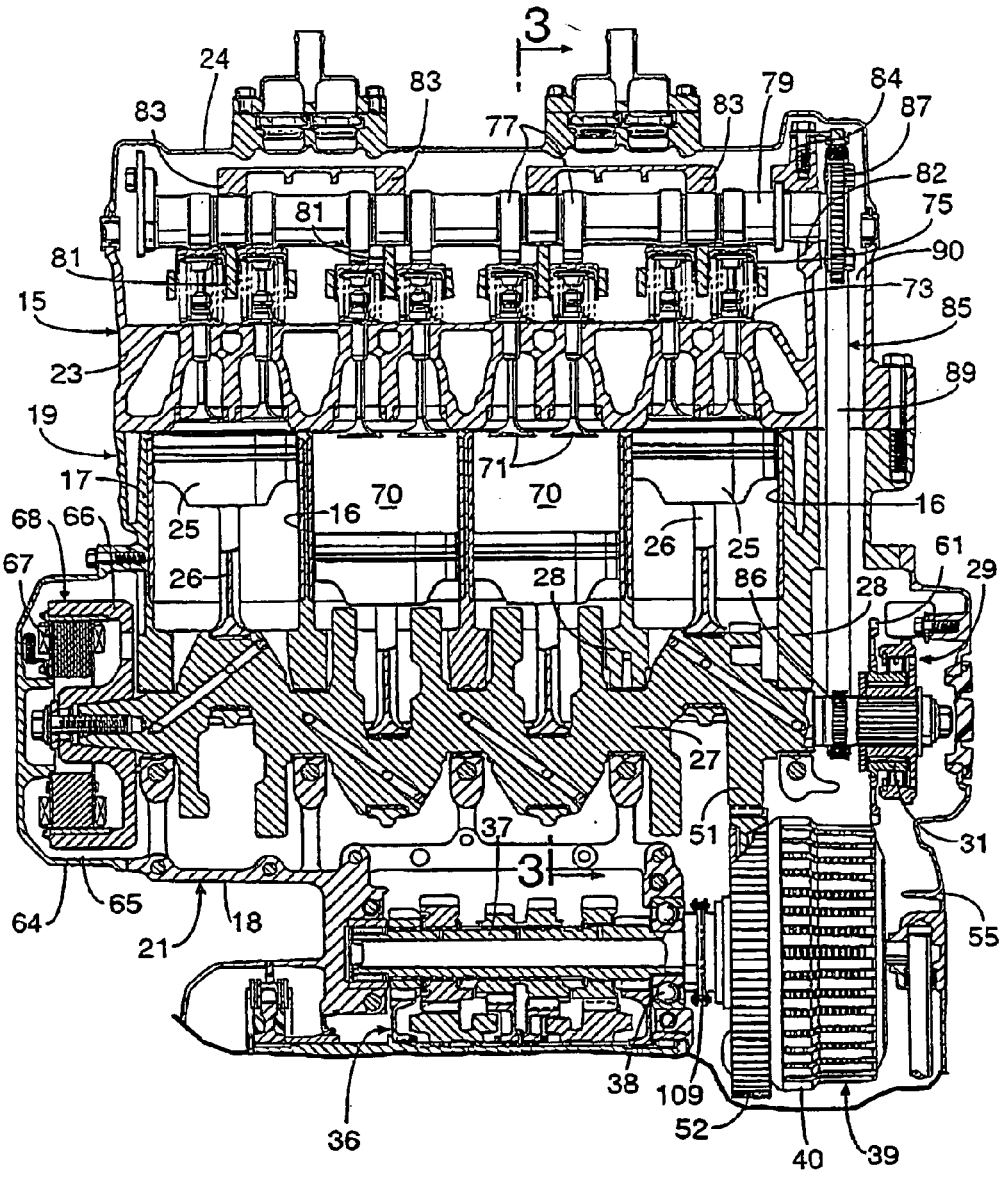
FIG. 2 is a sectional view taken on line 2—2 of FIG. 1.

Referring to FIGS. 1 and 2, a series 4-cylinder engine is mounted, for example, on a motorcycle. An engine body 15 having a forward-upwardly inclined cylinder axis C includes a cylinder block 19 integrally having a cylinder portion 17 provided with four cylinder bores 16 . . . disposed in series and an upper case portion 18 arranged under the cylinder portion 17. A lower case 20 is provided which cooperates with the upper case portion 18 to constitute a crankcase 21 that is connected to a lower part of the cylinder block 19. An oil pan 22 is connected to the lower part of the lower case 20, more specifically to the lower part of the crankcase 21.

A cylinder head 23 is connected to an upper part of the cylinder block 19. A head cover 24 is connected to the upper part of the cylinder head 23.

Pistons 25 . . . are slidably fitted in cylinder bores 16 . . . , respectively, and are connected to crankshafts 27 . . . through connecting rods 26 . . . . The crankshafts 27 are supported rotatably on a plurality of crank journal walls 28 . . . provided on the crankcases 21.

An overrunning clutch 29 is mounted on one end of the crankshaft 27 that projects from the crank journal wall 28 on one side in an axial direction of the crankshaft 27.

The overrunning clutch 29 is provided to input, into the crankshaft 27, rotational power from a start motor 34 that is mounted on the upper case portion 18 of the crankcase 21 in the engine body 15 with a rotational axis parallel with the crankshaft 27. A start gear transmission device 35 is provided between the start motor 34 and the overrunning clutch 29.

The start gear transmission device 35 includes a pinion 57 secured to an output shaft of the start motor 34, a large diameter gear 58 that is meshed with the pinion 57, a small diameter gear 59 which rotates integral with the large diameter gear 58, an idle gear 60 that is meshed with the small diameter gear 59, and a ring gear 61 that is provided to mesh with the idle gear 60 and is fixedly mounted on a clutch inner 31 of the overrunning clutch 29. Output of the start motor 34 is reduced in three stages, the pinion 57 and the large diameter gear 58, the small diameter gear 59 and the idle gear 60, and the idle gear 60 and the ring gear 61, and then transmitted to the crankshaft 27 through the overrunning clutch 29.

The output of the crankshaft 27 is changed in speed by a speed change gear 36 which is transmitted to a rear wheel which is a drive wheel. A main shaft 37 that is provided on the speed change gear 36 has an axis parallel with the crankshaft 27 and is supported rotatably on the upper case 18 of the crankcase 21 through a ball bearing 38 or the like.

A start clutch 39 interposed between the crankshaft 27 and the main shaft 37 is mounted on one end of the main shaft 37. Power is input into a clutch housing 40 on the input side of the start clutch 39 through the gears 51 and 52 from the crankshaft 27. When the start clutch 39 assumes a connected state, power from the crankshaft 27 is transmitted to the main shaft 37 through the start clutch 39.

The overrunning clutch 29 and the start clutch 39 are arranged at a position projecting from the side walls of the cylinder block 19 and the lower case 20 on one side along the axis of the crankshaft 27. A cover 55 for covering the overrunning clutch 29 and the start clutch 39 is fastened to the above-described side walls of the cylinder block 19 and the lower case 20.

The other end of the crankshaft 27 projects into a generator chamber 65 formed between the side wall of a cylinder block 19 on the other side along the axis of the crankshaft 27. A generator cover 64 is fastened to the cylinder bock 19. A rotor 66 is secured to the other end of the crankshaft 27 within the generator chamber 65. Further, a stator 67 that is surrounded by the rotor 66 is secured to the inner surface of the generator chamber cover 64. The rotor 66 and the stator 67 constitute a generator 68.

Figure 3:
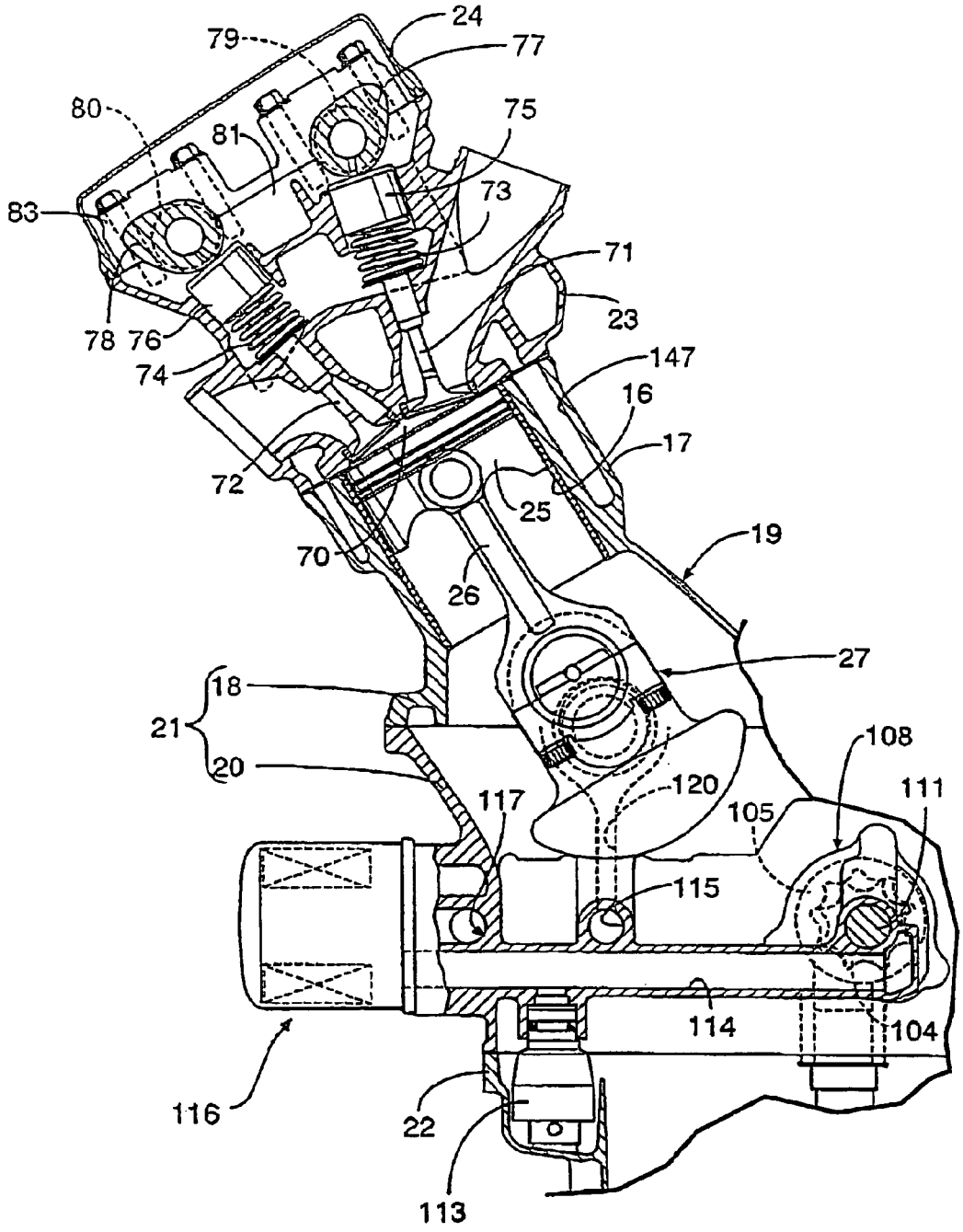
FIG. 3 is a sectional view taken on line 3—3 of FIG. 2.

Referring to FIG. 3 also, combustion chambers 70 . . . are formed between the tops of pistons 25 . . . , a cylinder portion 17 and a cylinder head 23 of a cylinder block 19. A pair of intake valves 71 and exhaust valves 72 . . . are provided for every combustion chamber and are disposed to open and close on the cylinder head 23. The intake valves 71 . . . and exhaust valves 72 . . . are biased in a valve-closing direction by means of valve springs 73 . . . , 74 . . . , respectively.

Lifters 75 . . . are in contact with the tops of intake valves 71 . . . that are fitted in cylinder heads 23 . . . to be slidably mounted in the direction along the opening/closing operating axes of the intake valves 71, respectively. Lifters 76 . . . are in contact with the tops of exhaust valves 72 . . . and are fitted slidably in the direction along the opening/closing operating axes of the exhaust valves 72, respectively.

Intake-side cams 77 are placed in sliding contact with the lifters 75 . . . from the side opposite the intake valves 71 . . . , and exhaust-side cams 78 are placed in sliding contact with the lifters 76 . . . from the side opposite the exhaust valves 72. The intake-side cams 77 . . . are provided integral with an intake-side cam shaft 79. The exhaust-side cams 78 . . . are provided integral with an exhaust-side cam shaft 80.

Cam journal walls 81 . . . are integrally provided on the cylinder head 23. The cam journal walls 81 . . . are arranged at positions corresponding to combustion chambers 70 . . . which are in common with the intake-side cam shafts 79 and the exhaust-side cam shafts 80. Cam journal walls 82 are arranged on one side along the axial direction of both the cam shafts 79, 80 and on the cam journal walls 81 . . . , 82 that are in common to the intake-side cam shaft 79 and the exhaust-side cam shaft 80 and are rotatably supported with cam holders 83 . . . , 84 fastened thereto and the cam journal walls 81 . . . , 82. Each pair of the four cam holders 83 is integrally connected.

Rotational power of the crankshaft 27 is reduced to ½ and transmitted to the intake-side and exhaust-side camshafts 79, 80 by a timing transmission device 85.

The timing transmission device 85 includes a drive sprocket 86 secured to the crankshaft 27 between the crank journal wall 28 on one side in the axial direction of the crankshaft 27 and the overrunning clutch 29. A driven sprocket 87 is secured to one end of the intake-side cam shaft 79 with a driven sprocket 88 secured to one end of the intake-side cam shaft 80. An endless cam chain 89 is stretched over the sprockets 86, 87 and 88. Moreover, the drive sprocket 86 and the lower part of the cam chain 89 are accommodated between the cylinder block 19 and the cover 85. The upper part of the cam chain 89 is accommodated to be free to operate in a cam chamber 90 provided in the cylinder head 23.

Figure 4:
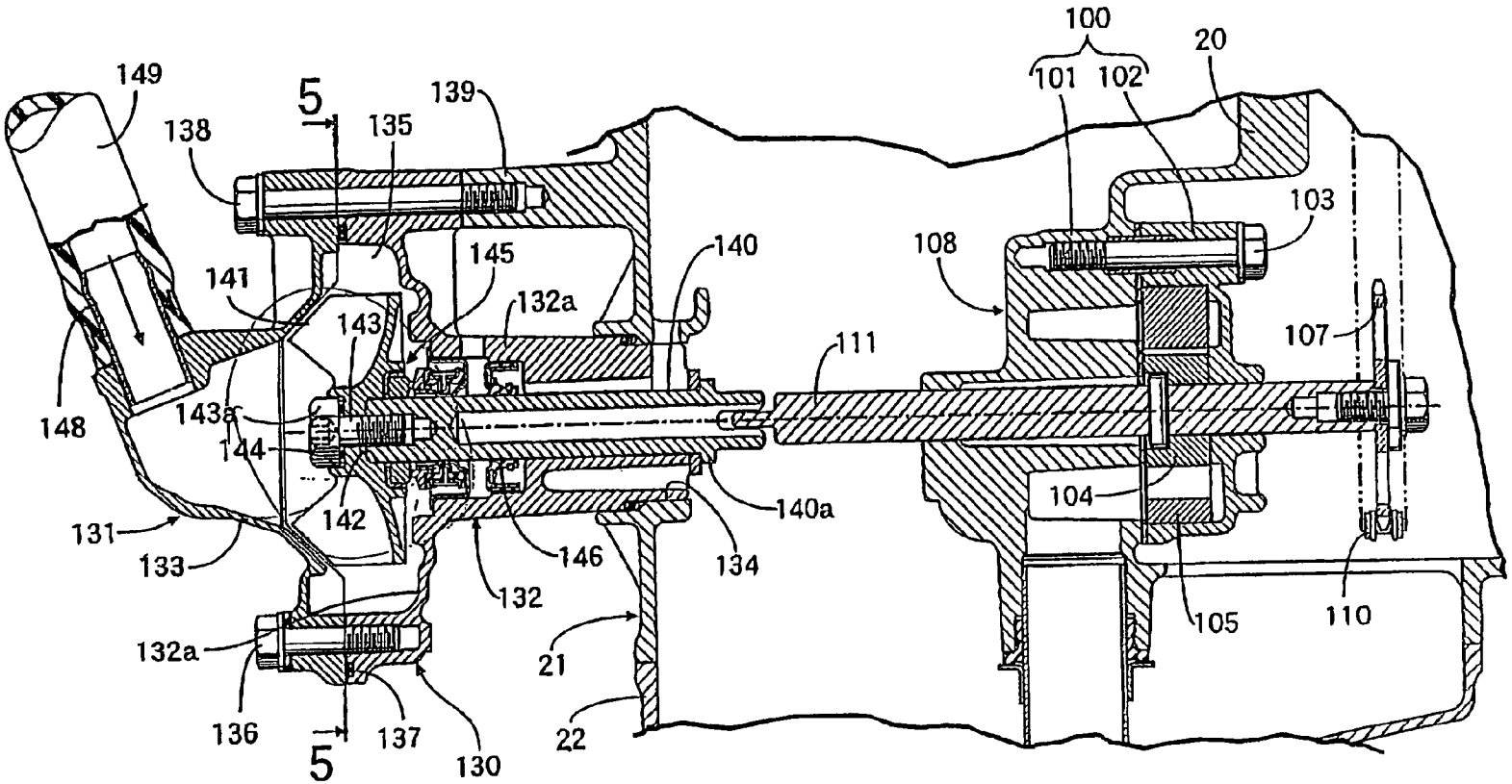
FIG. 4 is an enlarged sectional view taken on line 4—4 of FIG. 1.

In FIGS. 3 and 4, an oil pump 108 having a rotational axis parallel with the crankshaft 27 is mounted on the lower case 20 in the crankcase 21. An endless chain 110 is stretched over a drive sprocket 109 engaged relatively unrotatably with the clutch housing 40 of the start clutch 39. A driven sprocket 107 is secured to a rotational shaft 111 of the oil pump 108.

The oil pump 108 is of a trochoid type having a pump housing 100, an inner rotor 104 accommodated in the pump housing 100 secured to a rotational shaft 111, and an outer rotor 105 meshed with the inner rotor 104 and accommodated in the pump housing 100. The pump housing 100 includes a case portion 101 provided integral with the lower case 20 in the crankcase 21, and a cover 102 fastened by a plurality of bolts 103 . . . to the case portion 101. The rotational shaft 111 is supported rotatably on the pump housing 100 and rotatably extends through the pump housing 100.

Oil in the oil pan 22 is pumped up by the oil pump 108 through an oil strainer 112. The oil is discharged from the oil pump 108 to a discharge passage 114 provided in the lower case 20. Moreover, a relief valve 113 is interposed between the discharge passage 114 and the oil pan 22 to maintain a constant oil pressure in the discharge passage 114.

Oil is supplied from a main gallery 115 provided in the lower case 20 of the crankcase 21 to a lubricating portion between the crank journal walls 28 . . . and the crankshaft 27 and the speed change gear 36. The main gallery 115 is connected to a discharge port of the oil pump 108 through an oil filter 116 and an oil cooler (not shown). Passages 120 . . . for guiding oil to the lubricating portion between the crank journal walls 28 . . . and the crankshaft 27 are provided in the lower case 20 so as to communicate with the main gallery 115.

A sub-gallery 117 connected to an outlet of the oil filter 116 in parallel with the main gallery 115 so as to guide oil to the cylinder head 23 is provided in the lower case 20 of the crankcase 21.

The sub-gallery 117 causes the outlet of the oil filter 116 to communicate with an oil cooler (not shown), and causes an oil passage 124 provided in the crankcase 21 to communicate with the oil filter 116. The oil passage 124 is in communication with an oil passage 126 around the cylinder head 23 through an oil passage 125 provided in the cylinder portion 17 of the cylinder block 19.

A water pump 130 is arranged coaxial with the oil pump 108, and a pump housing 131 of the water pump 130 is mounted on the outer wall opposite the oil pump 108 in the lower case 20 of the crankcase 21.

The pump housing 131 includes a housing main body 132, and a cover 133 fastened to the housing main body 132. The housing main body 132 includes a journal portion 132*a* extending cylindrically and having one end fitted to be liquid-tight into an insert hole 134 provided in the lower case 20. A dish-like portion 132*b* is provided that is integral with the other end of the journal portion 132*a*. The cover 133 is fastened to the dish-like portion 132*b* by means of bolts 136 . . . so as to form a pump chamber 135 relative to the dish-like portion 132*b*. Moreover, a gasket 137 is provided for sealing the outer circumference of the pump chamber 135 and is interposed between the dish-like portion 132*b* and the cover 133. Further, a bolt 138 inserted into the cover 133 and the dish-like portion 132*b* is fastened to a support boss 139 that projects to the lower case 20 so as to receive the dish-like portion 132*b*.

A rotational shaft 140 coaxially extends through the journal portion 132*a* and is supported rotatably on the journal portion 132*a* of the housing main body 132. One end of the rotational shaft 140 is connected relatively unrotatably on the other end of the rotational shaft 111 in the oil pump 108. That is, the rotational shaft 140 is rotated by the rotational power transmission from the crankshaft 27.

Figure 5:
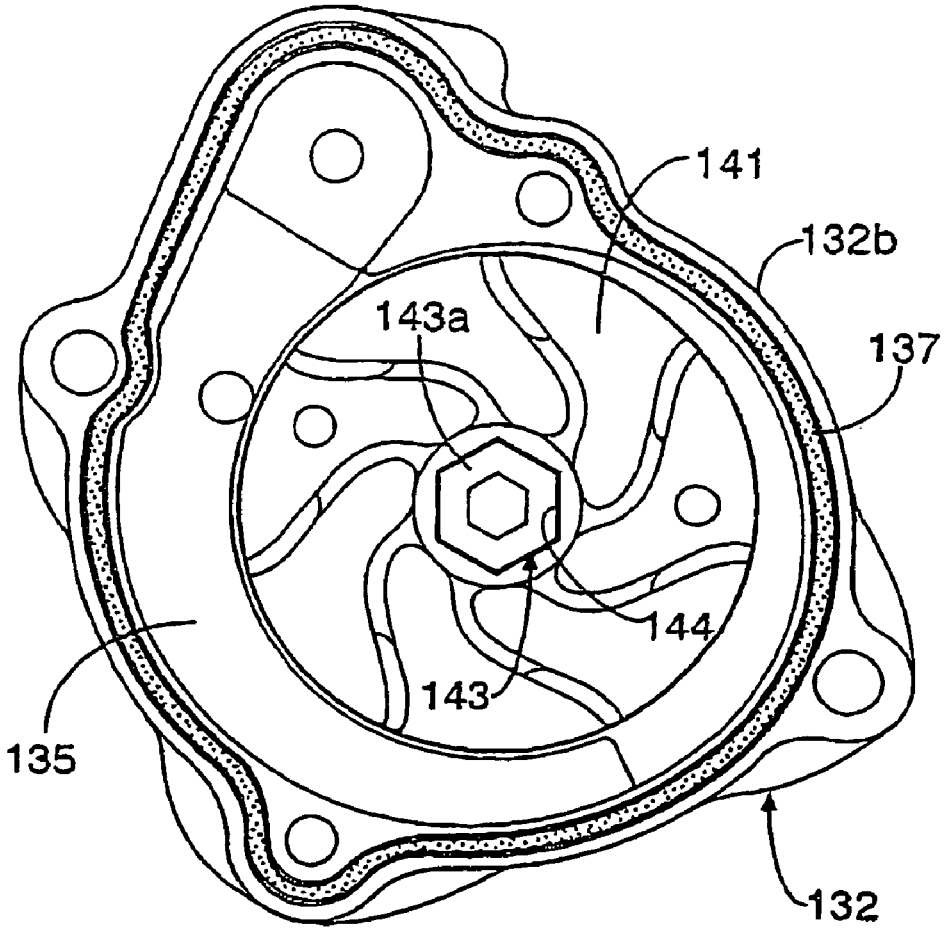
FIG. 5 is a sectional view taken on line 5—5 of FIG. 4.

Referring also to FIGS. 4 and 5, an impeller 141 is accommodated in the pump chamber 135 and is mounted on the other end of the rotational shaft 140 to project into the pump chamber 135. A radially outwardly projecting collar 140*a* is provided at least on the outer circumferential surface of a portion on the impeller 141 side of the rotational shaft 140. In this embodiment, one end of the rotational shaft 140 is provided and is formed to be straight in the axial direction in order to determine an axial directional position of the rotational shaft 140 so that the outer circumferential surface is straight except for the portion on which the collar 140*a* is mounted.

A fitting recess 142 for fitting the other end of the rotational shift 140 is provided in the central portion of the impeller 141 in order to mount the impeller 141 on the other end of the rotational shaft 140. A bolt 143 is inserted into the central portion of the impeller 141 and is threaded coaxial with the other end of the rotational shaft 140 and is fitted in the fitting recess 142.

Further, in the central portion of the impeller 141, for example, a hexagonal engaging recess 144 is provided facing the side opposite the fitting recess 142. A hexagonal enlarged diameter head 143*a* is provided on the bolt 143 and is fitted relatively unrotatably in the engaging recess 144.

Moreover, the rotational direction of the rotational shaft 140 and the impeller 141 is set to a direction in which the bolt 143, which is not able to rotate relatively to the impeller 141 by the resistance that is received by the impeller 141 from the cooling liquid within the pump chamber 135, is further tightened.

A well known mechanical seal 145 is provided so as to encircle the rotational shaft 140 at the end on the pump chamber 135 side of the journal portion 132*a* in the housing main body 132. An annular oil seal 146 is provided between the intermediate portion of the journal portion 132*a* and the rotational shaft 140.

Such a water pump 130 as described attracts the cooling liquid through a thermostat (not shown) from a jacket 147 on the cylinder head 23 side out of the cylinder block 19 and attracts the cooling liquid from a radiator not shown and delivers the cooling liquid to the jacket 147 on the cylinder block 19 side and an oil cooler. As shown in FIG. 4, a hose 149 for guiding the cooling liquid from the thermostat is connected to a connecting pipe 148 provided on the cover 133.

The operation of this embodiment will be described hereinafter. A water pump 130 is provided wherein the impeller 141 is mounted and accommodated in the pump chamber 135 of the pump housing 131 on the other end of the rotational shaft 140. The fitting recess 142 is provided for fitting the other end of the rotational shaft 140 having an outer circumferential surface which is straight in the axial direction at least in the portion on the impeller 141 side in the central portion of the impeller 141. The bolt 143 is inserted into the central portion of the impeller 141 and is threaded coaxial with the other end of the rotational shaft 140 so as to be fitted in the fitting recess 142.

According to the mounting construction of the impeller 141 to the rotational shaft 140 as described above, the reaction produced by receiving fluid resistance caused by the cooling liquid in the pump chamber 135 exerts a bending load on the fitting portion of the rotational shaft 140 and the impeller 141, and the bending load is not applied to the bolt 143. Moreover, since the outer circumferential surface of at least, on the impeller 141 side of the rotational shaft 140, is formed to be straight without a difference in level, the rotational shaft 140 is relatively large in diameter in the fitting portion into the fitting recess 142. Thus, the reliance of the mounting strength of the impeller 141 can be enhanced without making the rotational shaft 140 larger in diameter. Accordingly, the impeller 141 is to be rotated in a stabilized manner to enable an increase in the number of rotations of the engine and an increase in the size of the impeller 141. Thus, a high cooling effect is obtained without it being necessary to change other parts constituting the water pump 130. The present invention enables an avoidance of an increase in the costs. It is unnecessary to provide a difference in the level of the outer circumferential surface of the portion on the impeller 141 side of the rotational shaft 140. Thus, the cost can be reduced.

The engaging recess 144 for fitting the enlarged diameter head 143*a* of the bolt 143 is provided in the central portion of the impeller 141 facing to the side opposite the fitting recess 142. The rotational direction of the rotational shaft 140 and the impeller 141 is set to a direction in which the bolt 143 is further tightened by the resistance that is received by the impeller 141 from the cooling liquid in the pump chamber 135. Even if the bolt 143 should be loosen, the bolt 143 is further tightened by the rotation of the impeller 141, and positive tightening of the bolt 143 to the rotational shaft 140, that is, positive tightening of the impeller 141 to the rotational shaft 140 can be maintained.

While the embodiment of the present invention has been described, the present invention is not limited to the above-described embodiment, but various changes in design can be made without departing from the present invention described in claims.

As described above, according to the present invention, it is possible to enhance the reliability of the mounting strength of the impeller while avoiding an increase in cost.

Further, according to the present invention, it is possible to maintain a positive tightening of the impeller to the rotational shaft.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A water pump for cooling an engine in which an impeller is accommodated in a pump housing provided on an engine body wherein the impeller is mounted on an end of a rotational shaft rotatably supported on said pump housing comprising:

a fitting recess formed in said impeller for fitting an end of said rotational shaft having an outer circumferential surface which is straight in an axial direction at least a portion for engaging with said impeller, said fitting recess being formed in a substantially central portion of said impeller;

a bolt inserted into the substantially central portion of said impeller, said bolt being threaded in a coaxial direction with the end of said rotational shaft that is fitted in said fitting recess; and an engaging recess formed on a distal end of said impeller for engaging sides of a head of said bolt for positioning said bolt relative to said rotational shaft.

2. A water pump for cooling an engine in which an impeller is accommodated in a pump housing provided on an engine body wherein the impeller is mounted on an end of a rotational shaft rotatable supported on said pump housing comprising:

a fitting recess formed in said impeller for fitting an end of said rotational shaft having an outer circumferential surface which is straight in an axial direction at least a portion for engaging with said impeller, said fitting recess being formed in a substantially central portion of said impeller; and a bolt inserted into the substantially central portion of said impeller, said bolt being threaded in a coaxial direction with the end of said rotational shaft that is fitted in said fitting recess; and an engaging recess formed on a distal end of said impeller for engaging a head of said bolt for positioning said bolt relative to said rotational shaft, wherein a first end of said rotational shaft is connected to said impeller and a second end of said rotational shaft is connected to an oil pump; and wherein said engaging recess further tightens said bolt as said impeller is rotated.

3. The water pump for cooling an engine according to claim 1, and further including a seal mounted relative to said impeller and said rotational shaft for sealing a proximal end of said impeller relative to said rotational shaft.

4. The water pump for cooling an engine according to claim 1, wherein a bending load is applied to the impeller and the rotational shaft and is prevented from being applied to the bolt.

5. A water pump for cooling an engine in which an impeller is accommodated in a pump housing provided on an engine body wherein the impeller is mounted on an end of a rotational shaft rotatable supported on said pump housing comprising:

a fitting recess formed in said impeller for fitting an end of said rotational shaft having an outer circumferential surface which is straight in an axial direction at least a portion for engaging with said impeller, said fitting recess being formed in a substantially central portion of said impeller; and a bolt inserted into the substantially central portion of said impeller, said bolt being threaded in a coaxial direction with the end of said rotational shaft that is fitted in said fitting recess;

wherein a first end of said rotational shaft is connected to said impeller and a second end of said rotational shaft is connected to an oil pump; and wherein in the central portion of said impeller, an engaging recess for fitting an enlarged diameter head portion of said bolt relatively unrotatably is provided facing opposite to said fitting recess, and the rotational direction of said rotational shaft and said impeller is set to the direction in which said bolt is further tightened by the resistance that said impeller receives from the cooling liquid within said pump housing.

6. A water pump for cooling an engine comprising:

a pump housing provided on an engine body;

an impeller accommodated within said pump housing provided on the engine body;

a rotational shaft rotatably supported on said pump housing wherein the impeller is mounted on an end of said rotational shaft;

a fitting recess formed in said impeller for fitting the end of said rotational shaft, said fitting recess being formed in substantially a central portion of said impeller;

a bolt inserted into the substantially central portion of said impeller, said bolt being threaded into the end of said rotational shaft that is fitted in said fitting recess; and an engaging recess formed on a distal end of said impeller for engaging sides of a head of said bolt for positioning said bolt relative to said rotational shaft.

7. A water pump for cooling an engine comprising:

a pump housing, provided on an engine body;

an impeller accommodated within said pump housing provided on the engine body;

a rotational shaft rotatable supported on said pump housing wherein the impeller is mounted on an end of said rotational shaft;

a fitting recess formed in said impeller for fitting the end of said rotational shaft, said fitting recess being formed in substantially a central portion of said impeller;

a bolt inserted into the substantially central portion of said impeller, said bolt being threaded into the end of said rotational shaft that is fitted in said fitting recess; and an engaging recess formed on a distal end of said impeller for engaging a head of said bolt for positioning said bolt relative to said rotational shaft, wherein a first end of said rotational shaft is connected to said impeller and a second end of said rotational shaft is connected to an oil pump, and wherein said engaging recess further tightens said bolt as said impeller is rotated.

8. The water pump for cooling an engine according to claim 6, and further including a seal mounted relative to said impeller and said rotational shaft for sealing a proximal end of said impeller relative to said rotational shaft.

9. The water pump for cooling an engine according to claim 6, wherein a bending load is applied to the impeller and the rotational shaft and is prevented from being applied to the bolt.

10. A water pump for cooling an engine comprising:

a pump housing provided on an engine body;

an impeller accommodated within said pump housing provided on the engine body;

a rotational shaft rotatably supported on said pump housing wherein the impeller is mounted on an end of said rotational shaft;

a fitting recess formed in said impeller for fitting the end of said rotational shaft, said fitting recess being formed in substantially a central portion of said impeller; and a bolt inserted into the substantially central portion of said impeller, said bolt being threaded into the end of said rotational shaft that is fitted in said fitting recess, wherein a first end of said rotational shaft is connected to said impeller and a second end of said rotational shaft is connected to an oil pump, and wherein in the substantially central portion of said impeller, an engaging recess for fitting an enlarged diameter head portion of said bolt relatively unrotatably is provided facing opposite to said fitting recess, and the rotational direction of said rotational shaft and said impeller is set to the direction in which said bolt is further tightened by the resistance that said impeller receives from the cooling liquid within said pump housing.

11. A water pump for cooling an engine comprising:

a pump housing provided on an engine body;

an impeller accommodated within said pump housing provided on the engine body;

a rotational shaft rotatably supported on said pump housing wherein the impeller is mounted on an end of said rotational shaft;

a fitting recess formed in said impeller for fitting the end of said rotational shaft, said fitting recess being formed in substantially a central portion of said impeller;

a bolt inserted into the substantially central portion of said impeller, said bolt being threaded into the end of said rotational shaft that is fitted in said fitting recess; and a hexagonal engaging recess formed on a distal end of said impeller for engaging an enlarged diameter hexagonal head of said bolt for positioning said bolt relative to said rotational shaft such that the bolt is relatively unrotatably with respect to the impeller and thereby the bolt is further tightened by a resistance that the impeller receives from a cooling liquid within said pump housing.

12. The water pump for cooling an engine according to claim 11, and further including a seal mounted relative to said impeller and said rotational shaft for sealing a proximal end of said impeller relative to said rotational shaft.

13. The water pump for cooling an engine according to claim 11, wherein a first end of said rotational shaft is connected to said impeller and a second end of said rotational shaft is connected to an oil pump.

14. The water pump for cooling an engine according to claim 11, wherein a bending load is applied to the impeller and the rotational shaft and is prevented from being applied to the bolt.

15. The water pump for cooling an engine according to claim 1, wherein a first end of said rotational shaft is connected to said impeller and a second end of said rotational shaft is connected to an oil pump.

16. The water pump for cooling an engine according to claim 6, wherein a first end of said rotational shaft is connected to said impeller and a second end of said rotational shaft is connected to an oil pump.

* * * * *